US005160612A

United States Patent [19]

Skocic et al.

[11] Patent Number: 5,160,612

[45] Date of Patent: Nov. 3, 1992

[54] LIFTING SUPPORT FRAME FOR A FILTER PRESS

[75] Inventors: Ante Skocic, Limburg/Lahn; Jurgen Fresenius, Bad Schwalbach, both of Fed. Rep. of Germany

[73] Assignee: Passavant-Werke AG, Fed. Rep. of Germany

[21] Appl. No.: 644,600

[22] Filed: Jan. 23, 1991

[30] Foreign Application Priority Data

Jan. 29, 1990 [DE] Fed. Rep. of Germany ..... 4002510

[51] Int. Cl.[5] ..... B01D 25/12

[52] U.S. Cl. ..... 210/230; 210/237; 210/241; 210/249; 254/89 H

[58] Field of Search ..... 210/230, 231, 237, 241, 210/249; 100/199, 100; 248/167, 285, 649, 654, 671; 254/89 H, 91

[56] References Cited

FOREIGN PATENT DOCUMENTS 2510283 9/1976 Fed. Rep. of Germany ..... 210/241

OTHER PUBLICATIONS

Achema 1985 Prospectus—Date: 1985.
Article In Verfahrenstechnik—Date: Oct. 1985.
ATS Aquatec Systems Brochure—Date: May 1988.

*Primary Examiner*—Robert A. Dawson
*Assistant Examiner*—Matthew O. Savage
*Attorney, Agent, or Firm*—Larson and Taylor

[57] ABSTRACT

A new apparatus for extracting water from product or sewage sludge on the spot is provided. It is characterized by a frame matched to the dimensions of a low loader and having lifting supports which can be pivoted in and out and which have multi-step vertical adjustability. Filter presses of substantially higher capacity than those on known apparatuses employing a semitrailer can be used.

12 Claims, 3 Drawing Sheets

LIFTING SUPPORT FRAME FOR A FILTER PRESS

Figure 1:
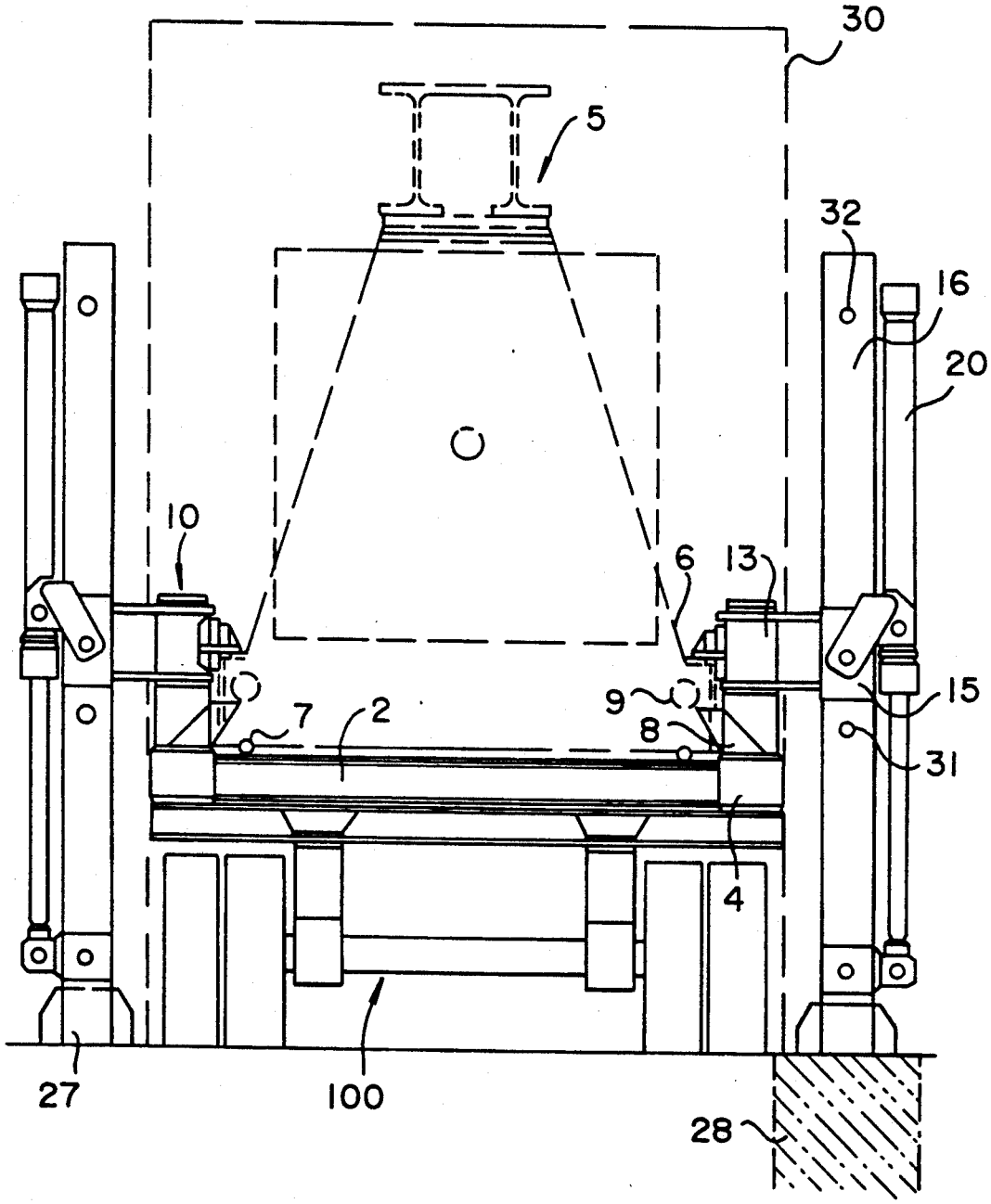

The invention relates to an apparatus for the mechanical extraction of water from product or sewage sludges on the spot. This apparatus consists of a conventional plate-filter press and of a frame receiving this press and which is equipped with appropriately adjustable lifting supports.

Plate-filter presses which can be set up for extracting water from sludge at the location where the sludge occurs are known (the ACHEMA 1985 prospectus of Messrs Schlammpress-Technik und Industriereinigung GmbH & Co KG/Dormagen). There, a plate-filter press is mounted on a conventional semitrailer. The semitrailer possesses, on the four corners, extendable lifting supports which hold the filter press at such a height that the filter cake can be collected, for example, in transportable refuse containers and transported away. The object was to develop a transport apparatus for a plate-filter press which has a substantially higher capacity. For this, it is necessary to utilize the transport width and height of a heavy goods vehicle to the greatest possible extent and so modify the frame that it can be erected and dismounted again by its own force. According to the solution for achieving this object, the frame is designed for transport by a low loader and is equipped with lifting supports which have hydraulic multi-step adjustability and which, in their highest position, are pivoted in to within the contour of the frame. The frame is therefore not itself a transport element, but has the dimensions and strength for transport by a standard low loader. Since a low loader allows a substantially greater constructional height of the filter press than a semitrailer, a press of higher capacity can be used. Furthermore, above the frame there is then more space for the lifting supports which are then generally also higher and which are moreover laterally pivotable and therefore do not project outwards beyond the contour of the frame during transport. In operation, the tending of the press is not impeded by the lifting supports then pivoted outwards. The space underneath the filter press is more readily accessible for filter-cake containers.

The pivoting device for each lifting support consists preferably of a bearing journal anchored at one frame corner and projecting vertically upwards and of a bearing bush which is pivotable via this bearing journal and which carries the sliding guide for the lifting support on a very short extension arm. At the same time, the lifting support and sliding guide preferably have a rectangular or square cross-section, so that there is no need for rotation-preventing means. The bearing bush can preferably be retained in the two positions of the extension arm by means of a crosspin.

Figure 2:
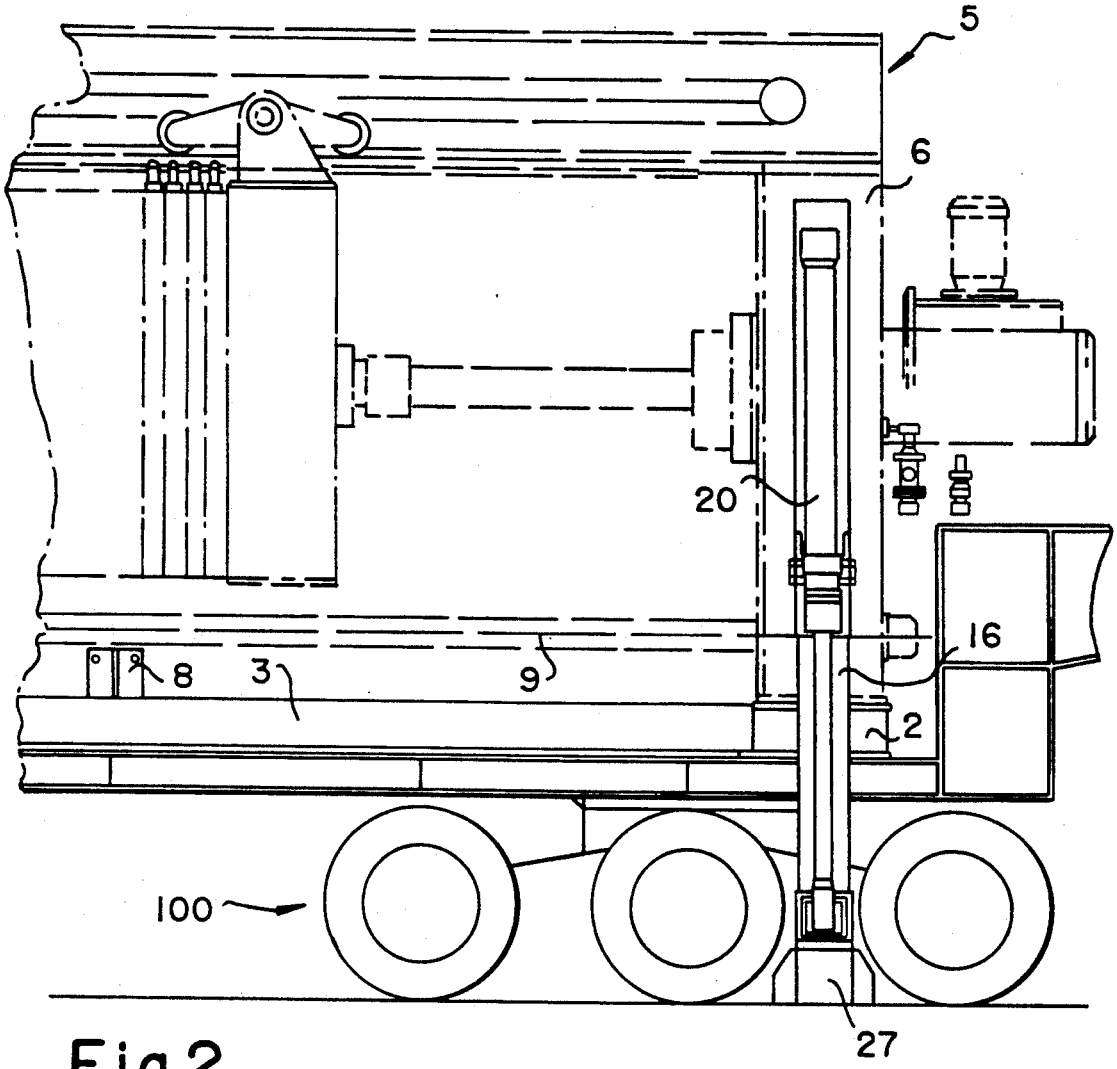
Figure 3:
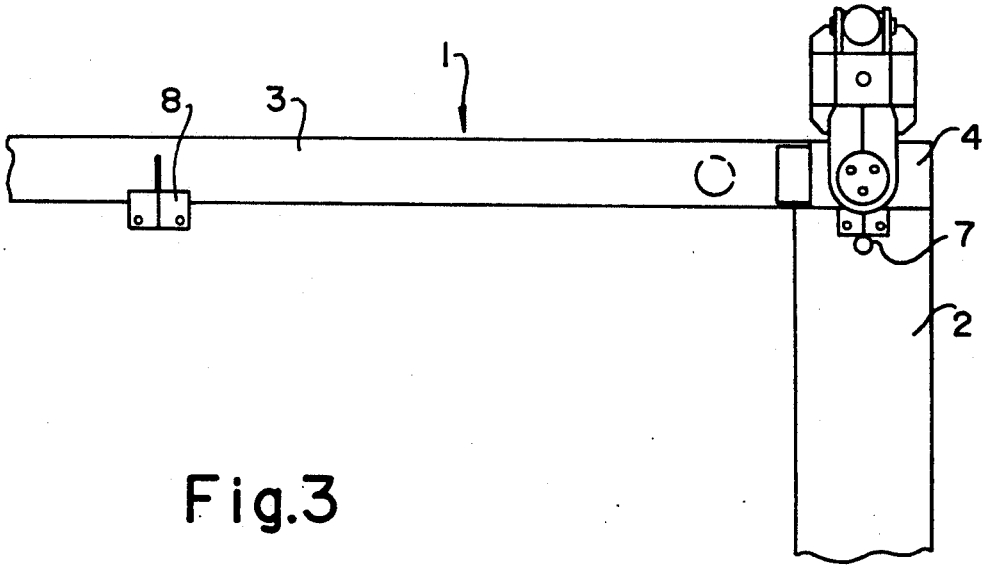
Figure 4:
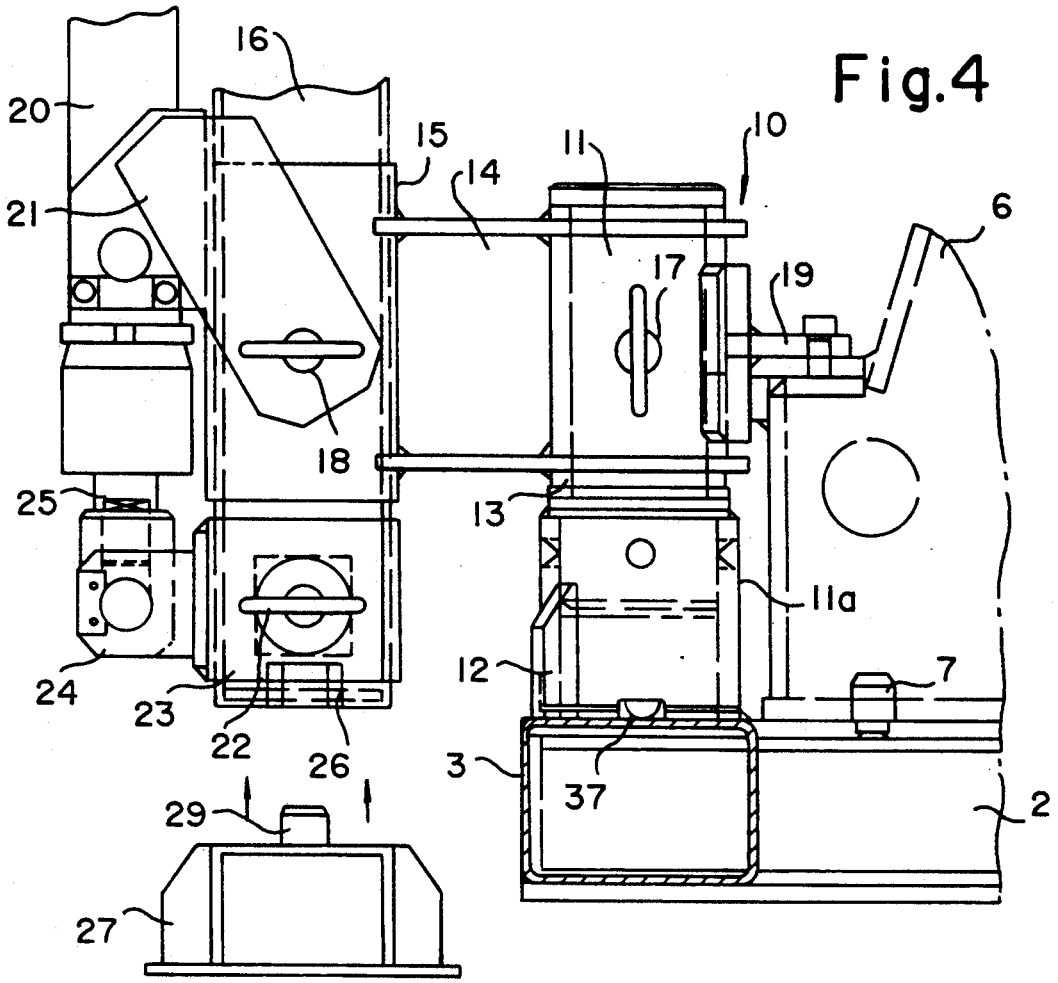
Figure 5:
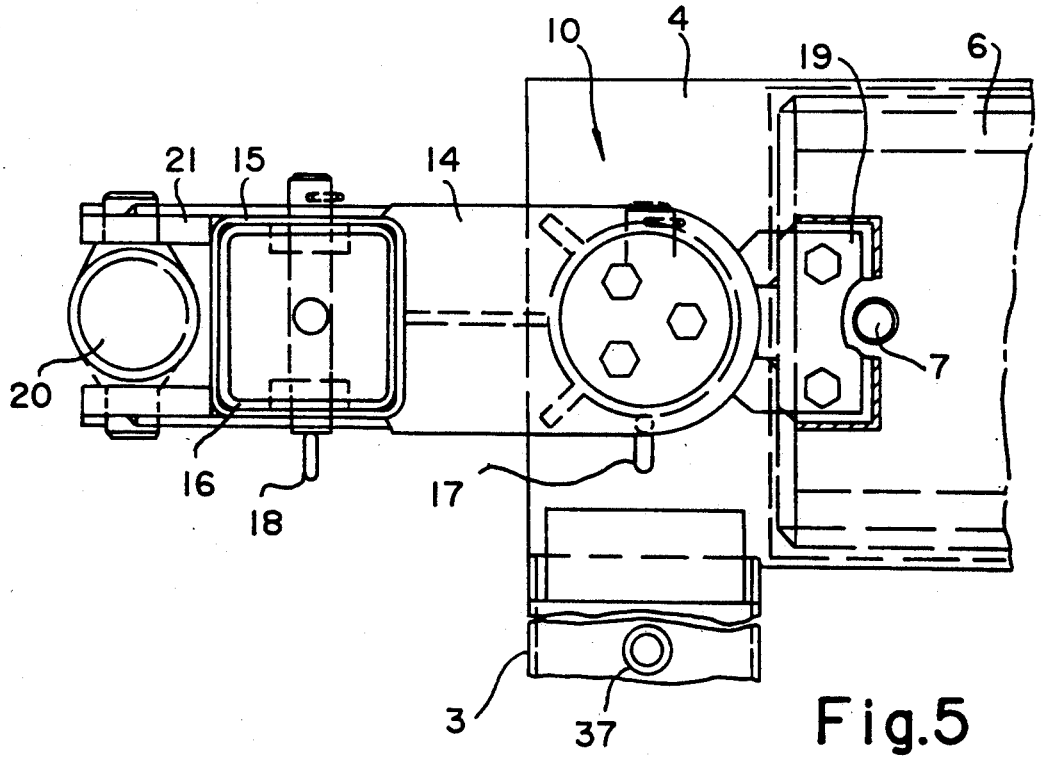

Further essential features of the new water-extraction apparatus emerge from the subclaims and from the following description of a preferred embodiment. In particular, in the drawing:

FIG. 1 shows an end view of the erected frame with a plate-filter press resting on it, FIG. 2 shows a side view of the same arrangement, FIG. 3 shows the top view of one corner of the frame, FIG. 4 shows an enlarged detailed end view of the pivot mounting of a lifting support, FIG. 5 shows the top view of the detail of FIG. 4.

FIGS. 1 and 2 show the erected frame positioned on a low loader 100. As shown especially in FIG. 3, the frame 1 consists of two crossheads 2 and two longitudinal sections 3 which are connected at the corners by means of junctions 4. The plate-filter press 5 rests with its stands 6 on the crossheads 2 only and is secured there exactly in position against displacement by means of studs 7. The triangular holders 8 provided on the longitudinal sections 3 serve for preventing the tension rods 9 of the filter press 5 from sagging in the no-load state.

The design of the lifting-support pivot bearings 10 can be seen from FIGS. 4 and 5. At bearing journals 11 there are column stubs **11*a* projecting vertically upwards which are anchored on the frame junctions 4 and which are welded into correspondingly ribbed brackets 12. Slipped over them is a bearing bush 13 which has a close fit and which carries a short extension arm 14 of double-T profile. The sliding guide 15 for the lifting support 16 consisting of a square tube is fastened to the free outer end of the extension arm 14. The two bearing elements can be retained in the pivoted-out position of the sliding guide 15 by means of crosspins 17, 18. The bearing bush 13 possesses, on its rear side, a tie strap 19 which, in the pivoted-out state of the lifting support 16, can be screwed together with the top side of the pressed stand 6**. Thus, in the erected state of the frame, the pivot bearing is connected to the filter press to form a structure resistant to pressure and tension. The bearing forces are transmitted to the press, without bending and shearing moments being generated.

The device for adjusting the lift of the lifting support contains a double-acting hydraulic piston 20, an articulation fork 21 and a sliding block 23 which is lockable relative to the lifting support 16 (crosspin 22) and in the lateral fork 24 of which is articulated the head of the piston rod 25. The sliding block 23 is closed at the bottom and there are possesses an insertion bush 26 for the stand foot 27 which is equipped with a corresponding stud 29 and which has a wide footplate for resting on a foundation 28 provided on the spot. The dimensions of the insertion bush 26 are such that it fits over the stud 37 located on the longitudinal section 3 of the frame and thus retains the lifting supports securely in the pivoted-in state, in which they cannot be pinned together with the bearing journal 11.

FIG. 1 shows the frame with the filter press 5, as it is when lifted off from the low loader During transport, the press occupies only the space 30 represented by dot-and-dashed lines. The lifting supports 16 do not project beyond this contour After the frame has been aligned above the foundations, the lifting supports are first raised from the studs 37 hydraulically and then pivoted outwards. In this position, the bearing bushes 13 are retained by means of the crosspins 17. All four lifting supports 16 are now extended in synchronism, and shortly before the foundations are reached the stand feet 27 are placed underneath. The sliding blocks 23 of the piston-rod heads are now released from the lifting supports 16 by a pull exerted on the crosspins 22 and subsequently are moved upwards as a result of the retraction of the piston rods 25. There, they are pinned together with the lifting supports 16 in the transverse holes 31. Subsequently, the transverse pin connections 18 of the sliding guides 15 can be released by subjecting the hydraulic cylinders to pressure in the lifting direction and the lifting supports 16 extended into the uppermost position, in which they are once again pinned together with the sliding guide (transverse bore 32).

The low loader can be moved out and the press connected and set in operation.

Dismantling takes place in reverse order.

We claim:

1. An apparatus for extracting water from a product or sewage sludge on the spot, comprising:

a plate filter press, an essentially rectangular frame receiving the plate filter press, the four corners of said rectangular frame defining a plane, the frame being adapted to fit onto the platform of a low loader transport vehicle and having a contour coinciding with said plane which includes a width substantially no greater than the width of the low loader transport vehicle, said frame having a plurality of lifting support means for lifting the frame and filter press in a raised position above the platform of the low loader transport vehicle, each said lifting support means being extendable between raised and lowered positions along a respective axis oriented perpendicularly to said plane, means for pivotally mounting each lifting support means to the major sides of said rectangular frame for movement between a raised pivoted in inoperative position and a lowered pivoted out operative position, each said means for pivotally mounting being pivotable about a respective axis oriented perpendicularly to said plane, wherein, in the raised, pivoted in inoperative position, the lifting support means are positioned over and within the width of the frame contour, and in the lowered pivoted out operative position the lifting support means are pivoted outwardly from the frame contour and extend downwardly therefrom for engagement with a foundation surface to support the frame above the foundation surface.

2. An apparatus according to claim 1, including a hydraulic piston and cylinder for moving each lifting support means vertically between the raised and lowered positions.

3. An apparatus according to claim 2, each means for pivotally mounting having associated therewith a bearing journal connected to and projecting upwardly from the frame, a bearing bush mounted on and pivotable horizontally about the bearing journal, guides connected to the bearing bush and slidably receiving the lifting support.

4. An apparatus according to claim 3, including four lifting support means, one located at each corner of the frame, wherein in the raised position, each lifting support is pivoted inwardly to a position within the outer contour of the width of the frame.

5. An apparatus according to claim 3, including locking means for locking each lifting support means at different vertical positions, relative to its guide.

6. An apparatus according to claim 5, wherein the locking means comprises crosspins insertable into matching cross holes in the guide and lifting support means.

7. An apparatus according to claim 2, wherein the end of a piston rod of the piston and cylinder is connected to the lower end of the lifting support means and the said guide is connected to a cylinder of the piston and cylinder.

8. An apparatus according to claim 7, wherein the connected of the end of the piston rod to the lifting support means comprises a sliding block which is slidable vertically along its lifting support and including crosspins for locking the sliding block at a plurality of different positions along the lifting support means.

9. An apparatus according to claim 1, wherein each lifting support means includes an insertion bush at its lower end, and including a releasably insertable standing foot adapted to be inserted into the insertion bush for bearing on the foundation when the lifting support is at its lowered, pivoted out operative position.

10. An apparatus according to claim 1, wherein the filler press includes a pair of stands, and the frame includes studs positioned to secure the stands of the filter press.

11. An apparatus according to claim 10, each means for pivotally mounting including a bearing journal connected to and projecting upwardly from the frame and a bearing bush mounted on and pivotable about the bearing journal and operatively connected to the respective lifting support means, each bearing bush having a tie strap which engages the respective stand of the filter press and is connectable thereto in the pivoted out position of the lifting support.

12. An apparatus according to claim 10, the lower end of each lifting support means including an insertion bush, the frame including a retaining stud projecting up from the frame and positioned to receive the insertion bush of its respective lifting support means when the lifting support is in its raised, pivoted in inoperative position, each lifting support means also having associated therewith a removably insertable standing foot which fits within said insertion bush when the lifting support means is in its pivoted out lowered operative position.

* * * * *